US005946892A

United States Patent [19]

Siddoway

[11] Patent Number: 5,946,892

[45] Date of Patent: Sep. 7, 1999

[54] CINCH

[75] Inventor: Brett L Siddoway, 4815 W. 5100 South, Hooper, Utah 84315

[73] Assignee: Brett L Siddoway, Hooper, Utah

[21] Appl. No.: 09/084,274

[22] Filed: May 26, 1998

[51] Int. Cl.[6] ..... B68C 1/14

[52] U.S. Cl. ..... 54/23

[58] Field of Search ..... 54/23, 35

[56] References Cited

U.S. PATENT DOCUMENTS

| | | | |
|---|---|---|---|
| 4,434,604 | 3/1984 | Bird | 54/23 |
| 5,426,924 | 6/1995 | Harty | 54/23 |
| 5,743,072 | 4/1998 | Chang | 54/23 |
| 5,768,864 | 6/1998 | Chang | 54/23 |

*Primary Examiner*—Robert P. Swiatek

[57] ABSTRACT

A cinch to pass beneath the belly of an animal in securing a saddle to the animal while minimizing discomfort and injury to the animal comprises a first layer of durable foam material having an outer surface covered with and molded with a durable stretch fabric to form a grid pattern with blocks separated by grooves on an outer surface of the first layer and with extensions from opposite ends of the first layer forming buckle recesses; a second layer of fabric covered foam corresponding to the shape of the first layer from end to end of the first layer; and a third layer sandwiched between the first and second layers and having a strap extending from end to end and a buckle on each end of the strap to rest in the buckle recesses formed in the extensions of the first layer.

5 Claims, 1 Drawing Sheet

CINCH

SPECIFICATION

1. Field of the Invention

This invention relates to cinches that pass beneath the belly of an animal such as a horse, mule, llama, etc. to secure a riding or pack saddle on the animal.

2. Prior Art

BRIEF DESCRIPTION OF THE INVENTION

Objects of the Invention

It is an object of the present invention to provide a cinch that will pass beneath the belly of an animal to securely hold a saddle placed on the animal against slipping.

Other objects are to provide a cinch that provides maximum comfort to the animal while securely holding a riding or pack saddle in place on the animal. Consequently, it is another object of the cinch of the invention to allow air flow between the animal and the cinch and to permit sweat from the animal to flow from between the animal and the cinch even when the cinch is secured tightly against the animal.

Still another object is to provide a cinch that can be secured to a saddle without providing friction causing connections that rub the hide of the animal to create abrasions and wounds.

Features of the Invention

Principle features of the invention include a first layer comprising a first elongate ethylene vinyl acetate foam core having a laminated animal engaging surface covering of a reinforced nylon, four way stretch fabric material. A grid pattern is formed in the animal engaging surface of the cinch, with the grids of the pattern being raised and separated by grooves. A second layer of the cinch is also formed from an elongate ethylene vinyl acetate core having a laminated outer surface, i.e. the surface remote from the animal engaging surface, of reinforced nylon, four way stretch fabric material.

A center strap is sandwiched as a third layer of the cinch, between the first and second layers. The center strap is preferably made of laminations of strong strap material extending over opposite faces of a flat, central plastic sheet shaped to have wings projecting from opposite sides of the center strap and from the ends of the central plastic sheet.

A transverse strap extends across the middle of the center strap, with D-rings at opposite ends thereof to pass through the second layer for connection of halter and other harness structure.

Buckles at opposite ends of the center strap rest in recesses formed to accommodate the buckles in the opposite ends of the first layer such that the buckles, when connected to saddle straps, will be held away from the animal on which the cinch is used, with the ends of the first layer providing a cushion against abrasive engagement of the buckles with the animal.

Additional objects and features of the invention will become apparent to those skilled in the art to which the invention pertains from the following detailed description and drawings.

THE DRAWINGS

In the drawings:

FIG. 1 is an exploded perspective view of the cinch of the invention;

FIG. 2, a top plan view of the cinch of the invention; and

FIG. 3, a bottom plan view of the invention.

DETAILED DESCRIPTION OF THE INVENTION

Figure 1:
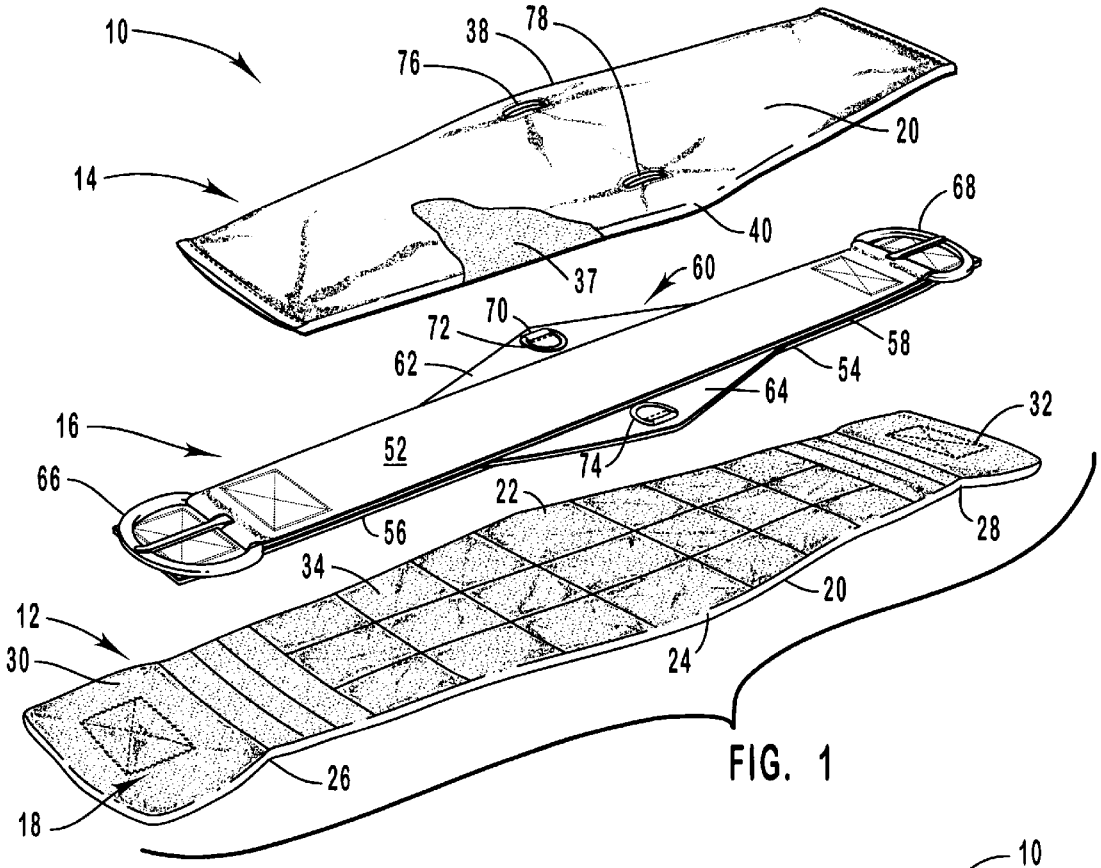
Figure 2:
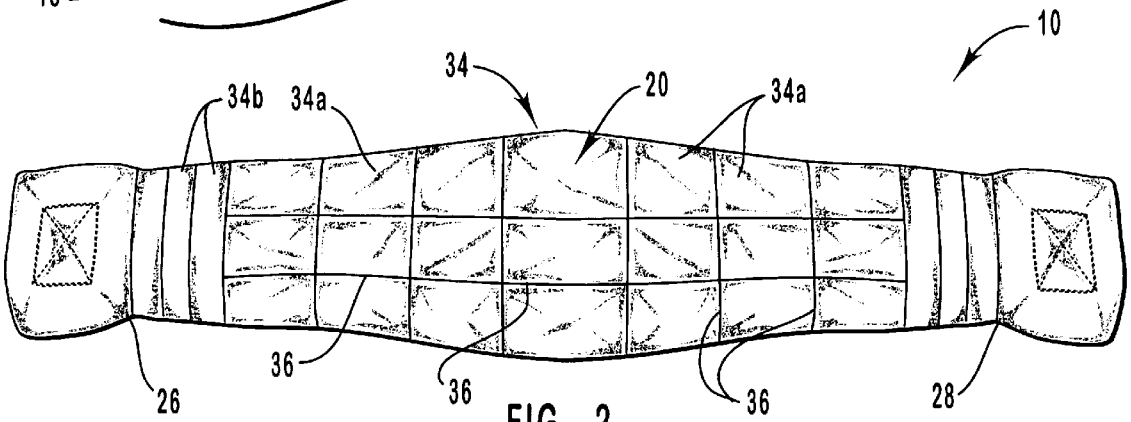
Figure 3:
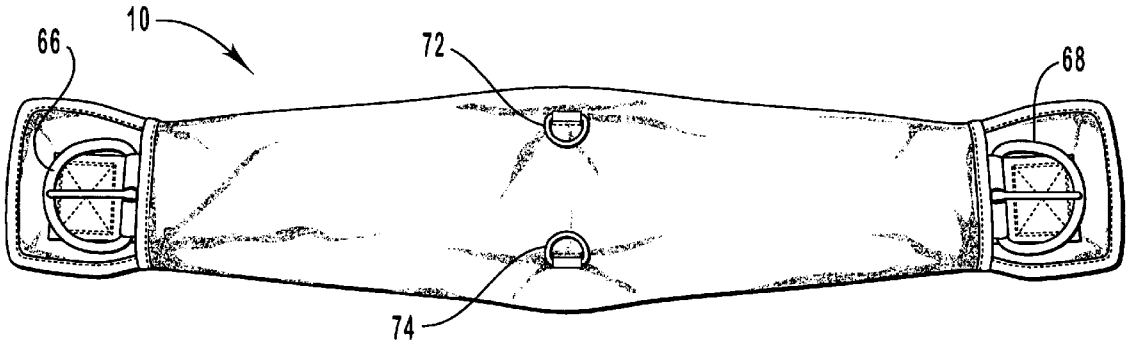

Referring now to the drawings:

As shown in FIGS. 1 and 2, a cinch 10 of the invention is made of a first layer 12, a second layer 14, and a third layer 16 that is sandwiched between the first and second layers.

First layer 12 comprises an inner elongate foam core 18 that has resiliency, strength and that is heat molded and heat bonded to a strong four-way stretch outer fabric cover 20. It has been found that an ethylene vinyl acetate foam is suitable for the core and that a reinforced nylon material is suitable for the outer fabric cover 20. Layer 12 is shaped to have side wings 22 and 24 and is tapered from the wings to ends 26 and 28 before terminating in buckle recesses 30 and 32 formed as extensions at opposite ends of the first layer 12. The outer stretch fabric cover 20 overlies the outer face of the elongate foam core 18, and the buckle recesses 30 and 32. The cover 20 is heat bonded to the core 18 and both the cover and the core are heat molded to have a grid pattern, with blocks 34 formed between grooves 36 on the outer face (animal engaging face) of the layer 12. The blocks 34 may, for example, have a generally rectangular shape 34*a,* they may be shaped as strips 34*b* or they may be in other patterns that will provide grooves that will carry sweat away from the belly of the animal on which the cinch is used. The grooves 36 extend transversely across the outer face of layer 12 or are connected to other grooves 36 that extend fully across to an outer edge of the face of layer 12.

Layer 14 comprises an elongate core 37 of the foam material, having side wings 38 and 40, and shaped to conform to the wings 22 and 24 of layer 12 formed between ends of the layer 12.

Layer 16 comprises straps 52, 54, 56 and 58, with straps 52 and 54 having spaced apart straps 56 and 58 sandwiched between them and a stiffener panel 60 positioned beneath the spaced apart straps 56 and 58 and sandwiched between straps 52 and 54. Panel 60 has side wings 62 and 64 that fit between the wings 22 and 24 of layer 12 and the wings 38 and 40 of layer 14. Buckles 66 and 68 are respectively secured to opposite ends of the straps. The straps 52, 54, 56, and 58 are preferably made of a strong strap material such as reinforced nylon.

A transverse strap 70 extends centrally across the layer 16 to have D-rings 72 and 74 at opposite ends thereof.

The cinch 10 is assembled with layer 16 positioned between layers 12 and 14, and the layers are sewn together such that buckle recesses 30 and 32 extend beyond ends 26 and 28 of layer 14 to receive buckles 66 and 68. The D-rings 72 and 74 extend through slots 76 and 78 formed in the layer 14 at the wings 38 and 40.

In use, the cinch 10 is passed beneath the belly of the animal to be saddled, with the outer face containing the grid, against the animal. The buckles 66 and 68 are connected to saddle straps that are pulled tight, with the cinch then being tight enough against the animal to hold the saddle in place even when a rider is on the saddle or a load is packed thereon. The formed buckle recesses in which the buckles are located prevent rubbing of the buckles on the animal during saddleing and movement of the animal with a saddle in place.

It has been found that sweat generated by movement of the saddled and loaded animal is absorbed by the cover 20 and, as the animal breathes, the collected sweat is squeezed by the breathing action from the cover into the grooves 36 and is dissipated.

Although a preferred form of my invention has been herein disclosed, it is to be understood that the present invention is by way of example and that variations are possible without departing from the subject matter coming within the scope of the following claims, which subject matter I regard as my invention.

I claim:

1. A cinch comprising a first elongate layer including an elongate foam core having resiliency, and strength heat bonded to a strong outer cover having four-way stretch covering an outer surface of said first elongate layer and extensions at opposite ends of said elongate foam core and shaped as buckle recesses;

a second elongate layer including a second elongate foam core corresponding in shape to said first foam core from end to end and having a four-way stretch outer cover bonded to an outer surface of said second elongate foam core; and a third elongate layer including laminated straps with buckles on opposite ends thereof, each buckle fitting in one of said buckle recesses.

2. A cinch as in claim 1, wherein the first elongate foam core and the first four way stretch cover are molded together to form a raised grid formation on the outer surface of said first layer, with blocks separated by grooves between the said blocks.

3. A cinch as in claim 2, wherein the third layer includes a plastic sheet centrally located within the laminated straps and projecting therefrom as wings to correspond to wings on the first and second layers, and a transverse strap having D-rings on the ends thereof secured to said plastic sheet and with said D-rings extending through slots provided therefor in said second layer.

4. A cinch as in claim 3, wherein the elongate foam core is made of ethylene vinyl acetate foam.

5. A cinch as in claim 4, wherein the outer covers are made from a reinforced nylon fabric material.

* * * * *